US010811760B2

(12) United States Patent
Dai

(10) Patent No.: US 10,811,760 B2
(45) Date of Patent: Oct. 20, 2020

(54) MULTI-BAND WINDOW ANTENNA

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 90 days.

(21) Appl. No.: 15/951,378

(22) Filed: Apr. 12, 2018

(65) Prior Publication Data

US 2019/0319334 A1 Oct. 17, 2019

(51) Int. Cl.

| | |
|---|---|
| ***H01Q 1/12*** | (2006.01) |
| ***H01Q 5/30*** | (2015.01) |
| ***H01Q 5/40*** | (2015.01) |
| ***H01Q 5/35*** | (2015.01) |

(52) U.S. Cl.

CPC ..... *H01Q 1/1271* (2013.01); *H01Q 5/30* (2015.01); *H01Q 5/35* (2015.01); *H01Q 5/40* (2015.01)

(58) Field of Classification Search

CPC ..... H01Q 1/1271; H01Q 5/30; H01Q 21/30
See application file for complete search history.

(56) References Cited

U.S. PATENT DOCUMENTS 3,728,732 A * 4/1973 Igarashi ..... B60J 1/02 343/713
4,746,925 A * 5/1988 Toriyama ..... H01Q 1/1271 343/700 MS
6,906,287 B2 * 6/2005 Sol ..... B32B 17/10036 15/250.05
7,071,886 B2 * 7/2006 Doi ..... H01Q 1/1271 343/713
7,847,745 B2 * 12/2010 Martin ..... B32B 17/10036 343/711
8,466,842 B2 * 6/2013 Dai ..... H01Q 13/10 343/712
9,337,525 B2 * 5/2016 Dai ..... H01Q 13/10
9,406,996 B2 * 8/2016 Lee ..... H01Q 1/528
9,564,674 B2 * 2/2017 Dai ..... H01Q 1/1271
9,653,792 B2 * 5/2017 Dai ..... H01Q 1/50
9,837,699 B2 * 12/2017 Dai ..... H01Q 1/1271
10,243,251 B2 * 3/2019 Gok ..... H01Q 1/1271
2005/0264461 A1 * 12/2005 Sugimoto ..... H01Q 1/1271 343/713
2007/0001915 A1 * 1/2007 Kono ..... H01Q 1/1271 343/713
2008/0169989 A1 * 7/2008 Li ..... H01Q 1/1271 343/713

(Continued)

FOREIGN PATENT DOCUMENTS

EP 2421090 A1 * 2/2012 ..... H01Q 1/1271

*Primary Examiner* — Ab Salam Alkassim, Jr.
(74) *Attorney, Agent, or Firm* — Dentons Cohen & Grigsby P.C.

(57) ABSTRACT

A window antenna wherein three embedded wires are laminated inside a glazing and a connector is attached to the joint end of the first and second wires and a signal input. The second antenna wire is longer and resonates at a lower frequency than the first antenna wire. A third antenna wire is a parasitic L-shape wire with part of the wire in close distance to the open end of the second antenna wire. The third antenna wire is electromagnetically coupled to the second antenna wire in the near field so that the antenna may support an additional resonance to provide multiband and wideband performance.

21 Claims, 7 Drawing Sheets

(56) References Cited

U.S. PATENT DOCUMENTS

| | | | | |
|---|---|---|---|---|
| 2008/0283173 | A1* | 11/2008 | Hisaeda | H01Q 1/1271 156/102 |
| 2009/0128431 | A1* | 5/2009 | Martin | B32B 17/10036 343/713 |
| 2012/0098716 | A1* | 4/2012 | Dai | H01Q 1/1271 343/713 |
| 2012/0171977 | A1* | 7/2012 | Talty | H04B 7/0604 455/205 |
| 2015/0222006 | A1* | 8/2015 | Dai | H01Q 1/1271 343/712 |
| 2015/0222010 | A1* | 8/2015 | Dai | H01Q 1/50 343/713 |
| 2015/0222242 | A1* | 8/2015 | Dai | H01Q 1/1271 333/33 |
| 2016/0226127 | A1* | 8/2016 | Niwano | H01Q 21/28 |
| 2017/0040662 | A1* | 2/2017 | Dai | H01Q 1/1271 |
| 2019/0312341 | A1* | 10/2019 | Tonoe | H01Q 9/30 |
| 2020/0176872 | A1* | 6/2020 | Baranski | H01Q 1/325 |

* cited by examiner

MULTI-BAND WINDOW ANTENNA

TECHNICAL FIELD

Field of the Invention

The presently disclosed invention relates to vehicle antennas, and more particularly to wideband and multi-band antennas having conductive wires disposed within a vehicle glazing.

BACKGROUND OF THE INVENTION

Discussion of the Prior Art

Automotive vehicles with antennas that are concealed in the vehicle windshield have improved vehicle styling by eliminating the need for a whip antenna that extends from the vehicle body. Such concealed antennas offer an added benefit in that they are less vulnerable to vandalism than whip antennas. Traditionally, such windshield antennas include the window glazing, a metallic frame that defines the window opening, an antenna wire, and an amplifier with an input port and an output port. The antenna wire is embedded in an interlayer of polyvinyl butyral that is laminated between a pair of glass sheets that form the glazing. Often, the amplifier input port is connected to a galvanized, flat cable connector and the amplifier output port is connected to a receiver by a coaxial cable. The amplifier is electrically connected to the frame as an electrical ground.

Most concealed wire antennas are limited to reception on AM and FM bandwidths. To achieve better transmission and reception, most concealed wire antennas known in the prior art have located the antenna wire in the center portion of the glazing. For example, U.S. Pat. No. 3,576,576 titled "Concealed Windshield Broadband Antenna" discloses a pair of L-shaped wire conductors that receive a feed signal at the bottom center of the windshield. The wires run upwardly in the middle of the window and spread apart at top of the windshield to form a pair of L-shaped wires that provide AM and FM reception. U.S. Pat. No. 3,728,732 titled "Window Glass Antenna" uses a similar pair of L-shaped wire conductors to form an FM antenna with an additional AM antenna wire that is located on the bottom of the windshield. The antenna elements are connected to a radio receiver through a switch that connects either the FM antenna or the AM antenna to the radio receiver. U.S. Pat. No. 3,845,489 titled "Window Antenna" discloses an antenna with a first "T" shaped antenna wire in the middle of the glazing. A second antenna wire embraces the first antenna wire and parallels the contour of the windshield frame. Both antenna wires are attached to a common terminal in the bottom center of the glazing. The dimensions of the antenna wires are complementary and produce an in-phase output for AM and FM signals. U.S. Pat. No. 4,602,260 titled "Windshield Antenna" discloses an active windshield antenna with separate transmission paths for a low frequency, low medium short wave region and an ultra-short wave region. The antenna wire runs from an antenna terminal and extends parallel to the frame. At the middle of the windshield, the antenna wire bends such that a portion of the antenna at the middle of the window is the primary antenna radiation element. Antennas such as the forgoing have provided only a single band FM antenna in the VHF frequency band and have a characteristic long, visible antenna wire that is located in the center of the glazing.

Preferably, a concealed antenna would have an antenna wire in which the feed signal is provided from a location other than the bottom center of the glazing. An antenna wire so arranged would avoid potential EMC interference sources such as the printed wiper heating circuit that is typically positioned at the bottom center location. Also preferably, the antenna wire would avoid the third visor area at the top center of the windshield proximate to the rear view mirror. It's especially common on vehicles equipped with electronics such as rain sensors, automatic high beam controls, night vision cameras, adaptive speed controls, and other features having windshield mounted sensors that are located in the third visor area. Antenna wires in the third visor area are similarly prone to RF interference with antenna reception.

In the past, vehicles have included only a limited number of antennas. In most cases, the vehicle systems required only an AM and an FM antenna. More recently however, vehicles have required an increasing number of antennas so that they are enabled to receive signals within a number of discrete frequency bands. Examples are frequencies for AM, FM, Satellite Radio, TPM, RKE, TV, DAB, GPS, Bluetooth, Collision Avoidance Radar, Parking Assist Radar and Electronic Toll Collection. In addition, some vehicles further include GSM, LTE, Wi-Fi, specialized Car-To-Car Communications and additional systems for automated drivers assist. Particularly at FM, DAB, and TV frequencies, vehicles increasingly require multiple antennas that afford diversity operation that will overcome multipath and fading effects. In most cases, separate antennas and antenna feeds have been used to satisfy each of those respective antenna requirements. However, providing multiple antennas with a plurality of monopole wires has become costly and tends to degrade the appearance of the vehicle.

Accordingly, there was a need in the prior art for an antenna, particularly an embedded wire antenna, that was capable of supporting multiple frequency bands to serve a variety of applications and needs. It was further required that such a multiband antenna would provide good performance while limiting visibility of the antenna wire in the daylight opening of the glazing.

SUMMARY OF THE INVENTION

The presently disclosed invention includes an embedded wire antenna that includes an outer glass ply, an interlayer, three conductive wires that are adhered to or embedded in the interlayer, an inner glass ply, and a galvanized connector that is soldered to the joint end of the two conductive wires near the edge of the glass ply. The connector joins the embedded antenna wire to a coaxial cable or other antenna module input/output.

Preferably, the disclosed antenna includes first and second antenna wires each of which may be divided into two segments: a first segment that is longitudinally oriented perpendicular to the window frame and parallel to the first segment of the other wire; and a second segment that extends into the daylight opening of the glazing and is oriented parallel to the window frame. The second segment of the one monopole antenna wire extends in an opposite direction from the second segment of the second monopole antenna wire. The first and second antenna wires are each monopole antennas with one of the first and second antenna wires being longer than the other of the first and second antenna wires. The length of each antenna wire is determined in accordance with the frequency band of interest with the length of the antenna wire being typically a quarter wavelength at the intended resonance frequency. The longer second antenna wire resonates at a lower frequency band than the first antenna wire. One end of the first segment of each monopole antenna wire is electrically connected to an antenna connector. The other end of the first segment of each monopole antenna wire is joined to the second segment of the respective antenna wire.

The disclosed antenna includes a third antenna wire that is an L-shaped wire. Part of the third antenna wire is parallel to and spaced laterally proximate to a length of the second segment of the second antenna wire. The third antenna wire also may be located to extend past the distal end of the second segment of the second wire to which it is parallel and proximately located. The third antenna wire is laterally spaced from the second segment of the first or second antenna wire such that the third antenna wire is electromagnetically coupled to the second antenna wire so that the third antenna wire supports an additional resonant signal according to the length of the third antenna wire. In this way, the disclosed antenna provides multiband performance.

The antenna structure may include additional antenna wires that are similarly arranged with respect to each other. The additional antenna wires may be coupled to the first antenna wire so that the first antenna wire may serve as a tunable parasitic antenna resonating element that tunes the additional antenna for higher frequency applications. Multiple antenna wires can also be placed on both sides of the window to support multiple wireless communications or diversity reception.

In one example of the disclosed antenna, the first resonant bandwidth of the first antenna may correspond to FM band of 76-108 MHz and the second resonant bandwidth of first antenna may correspond to DAB band of 174-240 MHz. The second antenna may resonant at TV band 3 of 174-230 MHz and TV band 4 and 5 of 470-800 MHz. The third antenna may be tuned to resonate at RKE antenna frequencies of 315 MHz and 434 MHz.

BRIEF DESCRIPTION OF THE DRAWINGS

A more complete description of the presently disclosed invention can be had by reference to the embodiments illustrated in the accompanying drawings and described below by way of examples of the invention. In the drawings.

DETAILED DESCRIPTION OF THE INVENTION

Figure 1:
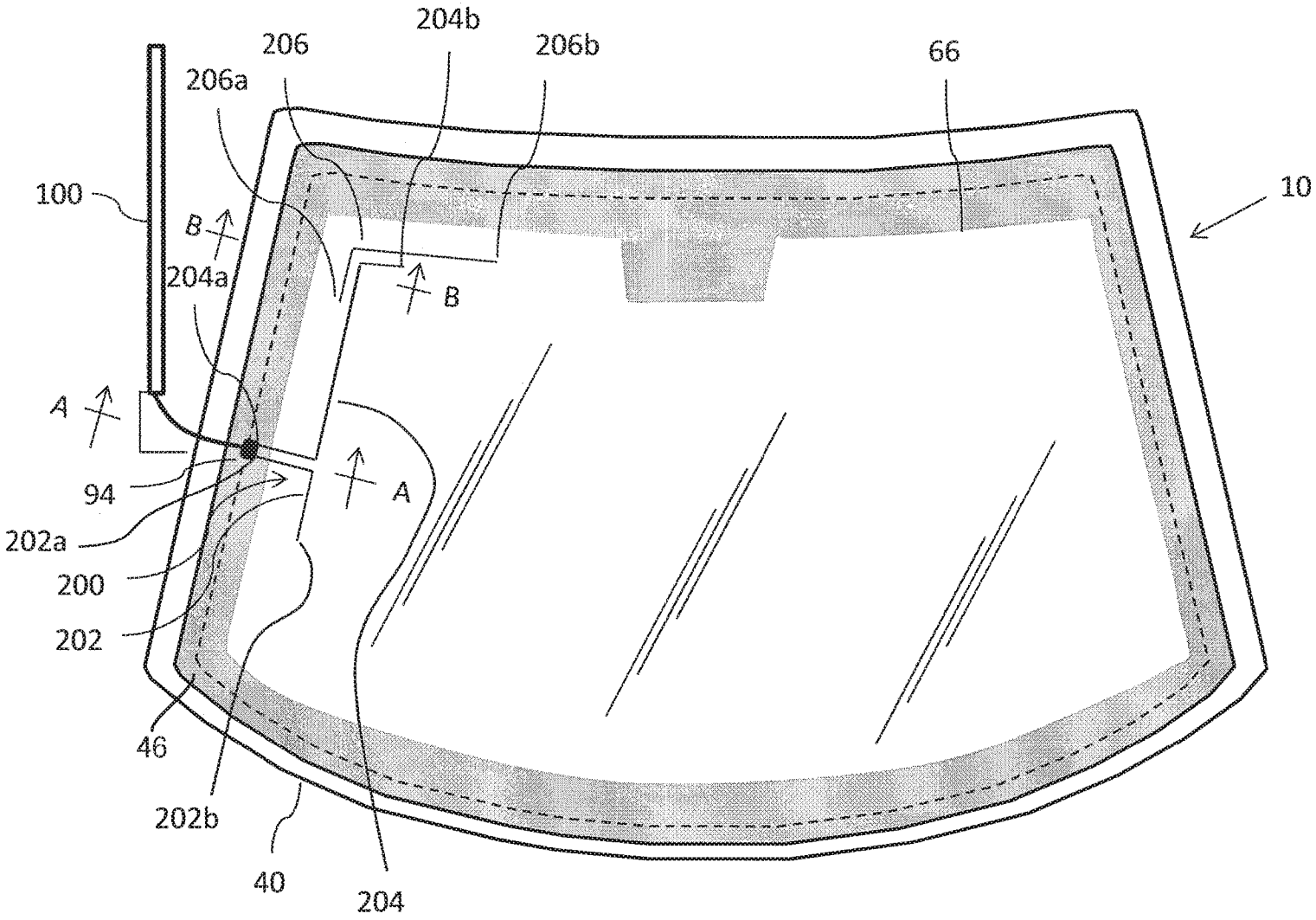
FIG. 1 is a plan view of an antenna windshield that incorporates features of the presently disclosed invention.
Figure 2:
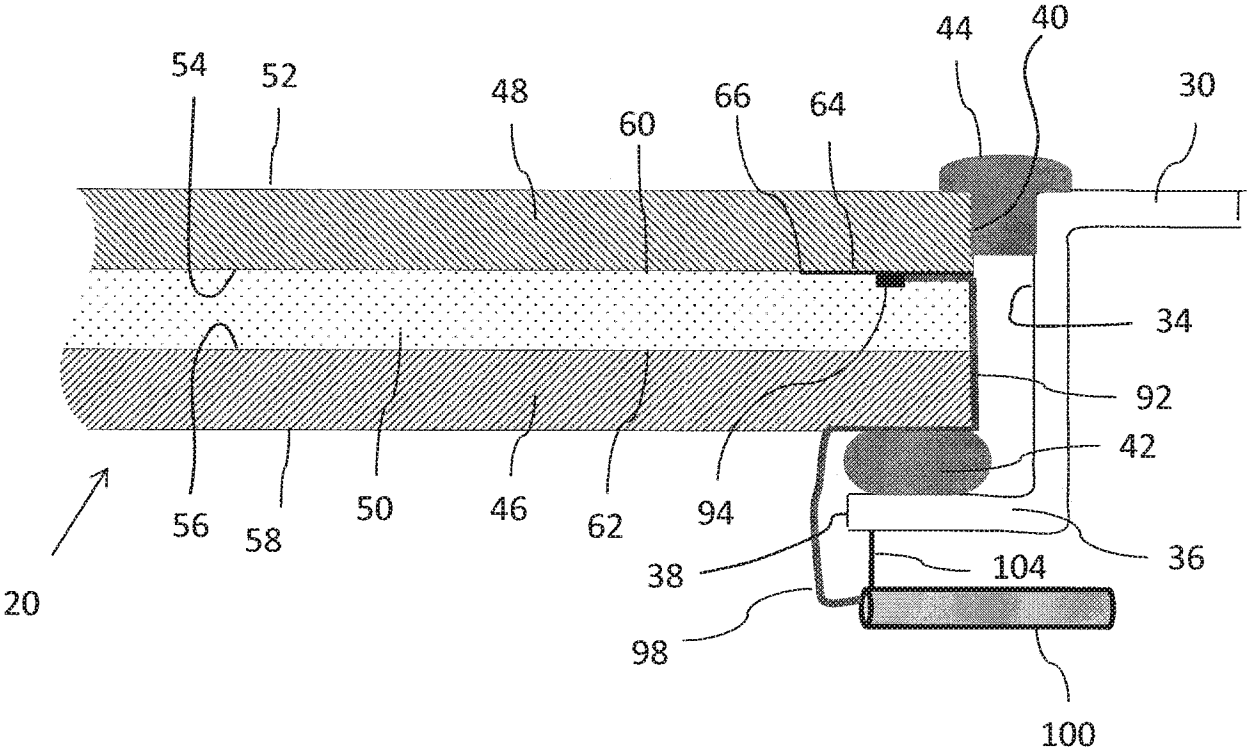
FIG. 2 is a partial cross-section of the windshield of FIG. 1 taken along line A-A in FIG. 1.
Figure 3:
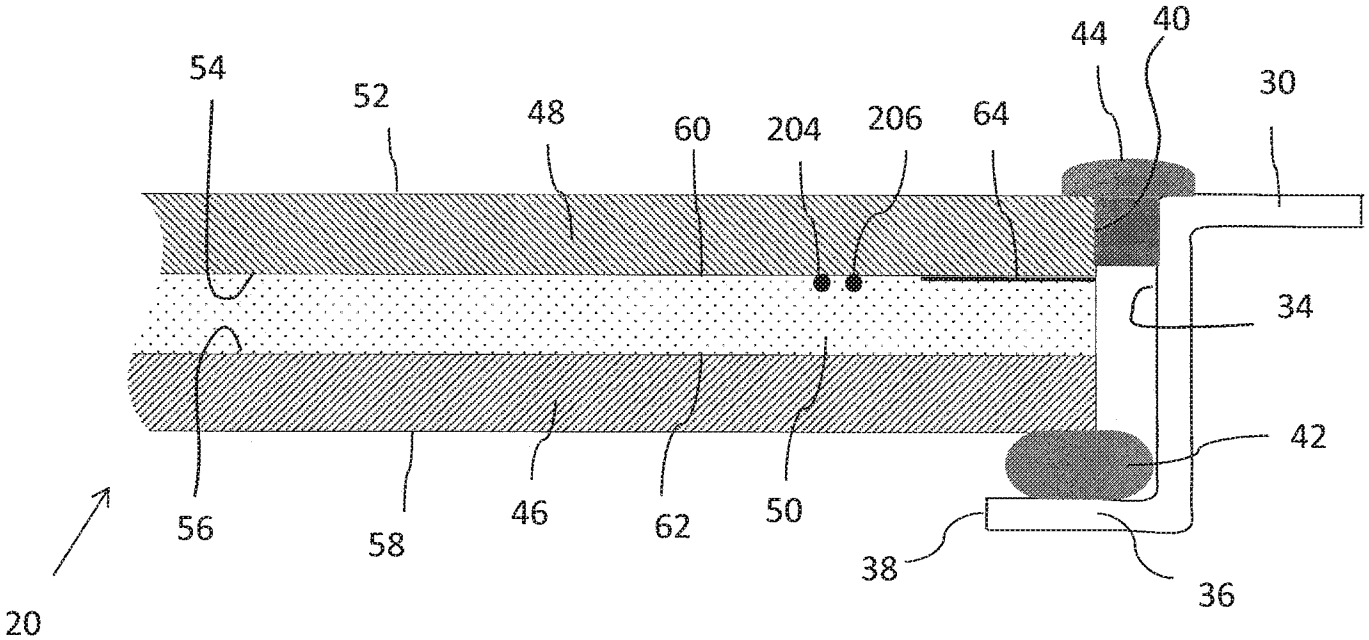
FIG. 3 is a partial cross-section of the windshield of FIG. 1 taken along line B-B in FIG. 1.

FIG. 1 is a plan view of the windshield antenna 10 and its associated structure incorporating features of the presently disclosed invention. In FIGS. 1, 2 and 3, a glazing 20 is surrounded by a metal frame 30 of a vehicle body. Frame 30 defines a surface 34 that forms a portal for receiving glazing 20. Portal surface 34 includes the surface of an annular flange 36 that has an edge 38. Glazing 20 defines an outer perimeter edge 40 that overlaps annular flange 36 to mount glazing 20 in body 30. As shown in FIG. 2, an annular seal 42 is located between perimeter edge 40 of window glazing 20 and annular flange 36. FIG. 2 also shows a molding 44 that bridges the outer gap between annular flange 36 and glazing 20.

In the embodiment of FIGS. 1 and 2, glazing 20 is a laminated glazing that includes inner transparent ply 46 and outer transparent ply 48 that may be composed of glass. Inner ply 46 and outer ply 48 are bonded together by an interlayer layer 50. Preferably, interlayer 50 is made of a polyvinylbutyral or similar material. Outer ply 48 has an outer surface 52 (conventionally referred to as the number 1 surface) that defines the outside of glazing 20 and an inner surface 54 (conventionally referred to as the number 2 surface). Inner surface 54 is oppositely disposed on outer ply 48 from outer surface 52. Inner ply 46 has an outer surface 56 (conventionally referred to as the number 3 surface) that faces internally on glazing 20 and an inner surface 58 (conventionally referred to as the number 4 surface) that defines the inside of glazing 20 and faces internally to the vehicle. Interlayer 50 defines an outer surface 60 that faces surface 54 of outer ply 48 and an inner surface 62 that is oppositely disposed on interlayer 50 from outer surface 60 and that faces surface 56 of inner ply 46.

As shown in FIG. 2, glazing 20 may include a concealment band 64 such as a paint band that is applied to outer ply 48 by screen printing opaque ink around the perimeter of surface 54 of outer ply 48 and then firing the perimeter of the outer ply. Concealment band 64 has a closed inner edge 66 that defines the boundary of the daylight opening (DLO) of glazing 20. Concealment band 64 is sufficiently wide to cover apparatus that is included near the outer perimeter of glazing 20.

Antenna wires 202, 204 and 206 collectively serve as an antenna 200. Antenna wires 202, 204 and 206 each have respective first and second longitudinal ends 202*a*, 202*b*, 204*a*, 204*b*, 206*a* and 206*b* and are embedded in surface 60 of interlayer 50. Antenna wires 202, 204 and 206 are preferably coated with a dark colored coating to minimize the visibility of the wire within the daylight opening of glazing 20. In the presently disclosed embodiment, wires 202, 204 and 206 each have a respective center core with a diameter in the range 30 μm to 150 μm. Preferably, antenna wires 202, 204 and 206 have a center core with a diameter in the range of 60 μm to 90 μm. One end 202*a* of antenna wire 202 and one end 204*a* of antenna wire 204 are connected to a conductive solder patch 94.

As illustrated in FIG. 2, a copper foil 92 is galvanically connected to a solder patch 94. Copper foil 92 is also connected to the center conductor 98 of coaxial cable 100 or other vehicle electronic device (not shown). Preferably copper foil 92 is covered by plastic tape so that it is electrically isolated from portal surface 34 and does not short out radio frequency signals at locations where it passes portal surface 34 and annular seal 42. Cable ground wire 104 is connected to flange 36 near portal surface 34.

Antenna wires 202 and 204 are oriented within glazing 20 in the shape of L-shaped monopole antennas. Each antenna wire 202 and 204 is about one-quarter wavelength long at a frequency corresponding to a predefined resonate frequency for the respective wire. In the example of the preferred embodiment, antenna wire 204 is longer than antenna wire 202 so that antenna wire 204 resonates at a lower frequency band than antenna wire 202 and antenna wire 202 resonates at a higher resonate frequency band than antenna wire 204. Lower band wire 204 enables antenna 200 to exhibit antenna resonance at lower band frequencies such as, for example, the FM band from 76 MHz to 108 MHz or other suitable frequencies. Shorter antenna wire 202 enables antenna 200 to exhibit resonance at a higher band frequency such as, for example, resonance at the frequency range between 174 MHz to 240 MHz or other suitable frequency range.

In wire antennas known in the prior art with only a single antenna wire, the length of the wire was adjusted so that resonant frequency occurred at the center frequency of the intended operating band. However, such wire antennas do not provide sufficiently wide frequency bandwidth for many applications. When the antenna wire is tuned to the center frequency of a wide operating bandwidth, the antenna tends to perform poorly at the lower and higher portions of the frequency band. The presently disclosed invention employs a plurality of antenna wires to provide a corresponding plurality of narrower frequency bands. Collectively, the plurality of bands compose an effective wide operating frequency bandwidth. Each antenna wire is tuned to a relatively narrower band and the respective component bands overlap the adjacent band or bands to achieve enhanced wide-band antenna performance.

Antenna wire 206 may be used to support part of the high frequency band. Antenna wire 206 is a parasitic wire that is closely coupled to antenna wire 204 near the open or distil end 204*b* of wire 204. Antenna wire 206 causes parasitic capacitive top loading of antenna wire 204 that causes antenna 200 to resonate additionally in the high frequency band. The relative bands of antenna wires 202, 204 and 206 can be tuned such that the combination of all three antenna wires results in a wider antenna bandwidth or in performance over a plurality of separate frequency bands.

Figure 4:
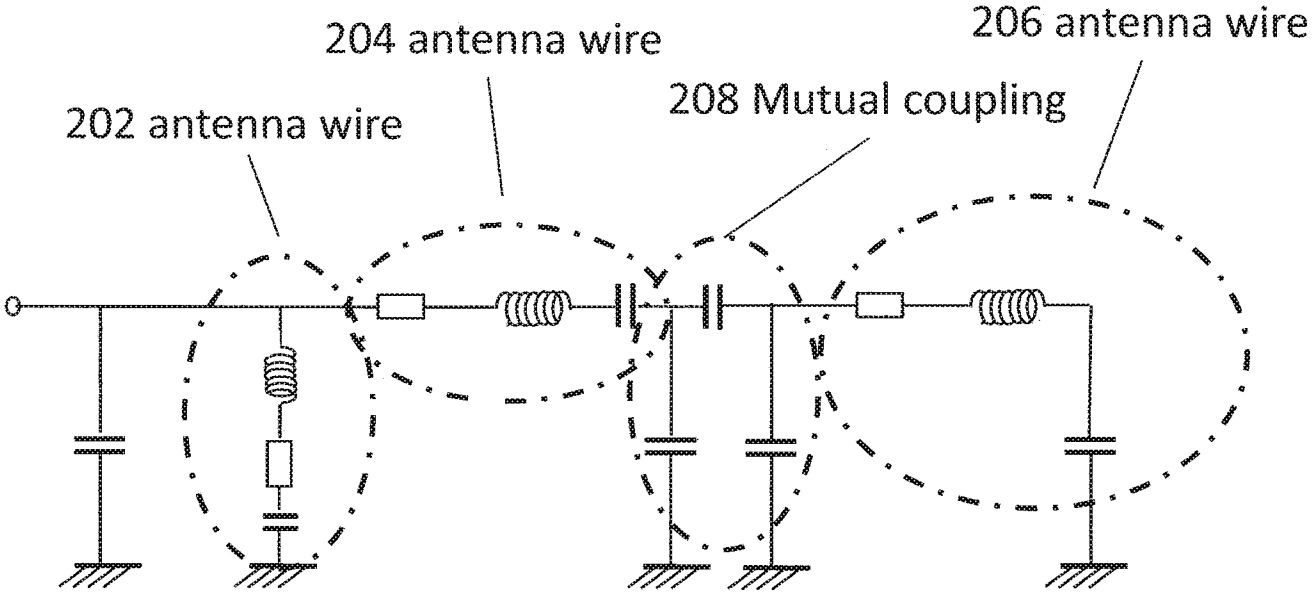
FIG. 4 shows an equivalent lumped-elements circuit model for the antenna according to the present invention.

FIG. 4 illustrates an equivalent circuit model of the antenna wires 202, 204 and 206 that are shown in FIGS. 1-3. In FIG. 4, the self-impedances of each antenna wire is equated to an equivalent electrical circuit that is a series R-L-C resonant circuit. Additional shunt capacitance at the terminal represents the coupling capacitance between antenna 200 and the surface of the vehicle frame. In the equivalent circuit model, antenna 200 includes three radiator equivalent elements. Elements 202 and 204 are arranged in shunt and elements 204 and 206 are arranged in series. Added mutual coupling impedance 208 is the result of the first segments of antenna wires 202 and 204 being located parallel to each other. Resistance, capacitance and inductance corresponding to each resonate equivalent model is selected to cause the resonant frequency to equate to antenna resonate frequency of a vehicle antenna. Each radiator model can be tuned to different resonate frequencies in accordance with the respective length of each antenna wire 202, 204 and 206 to achieve a multiband antenna pattern. Alternatively, the radiator models can be tuned to different segments of a continuous frequency band to produce a wideband antenna pattern.

Figure 5:
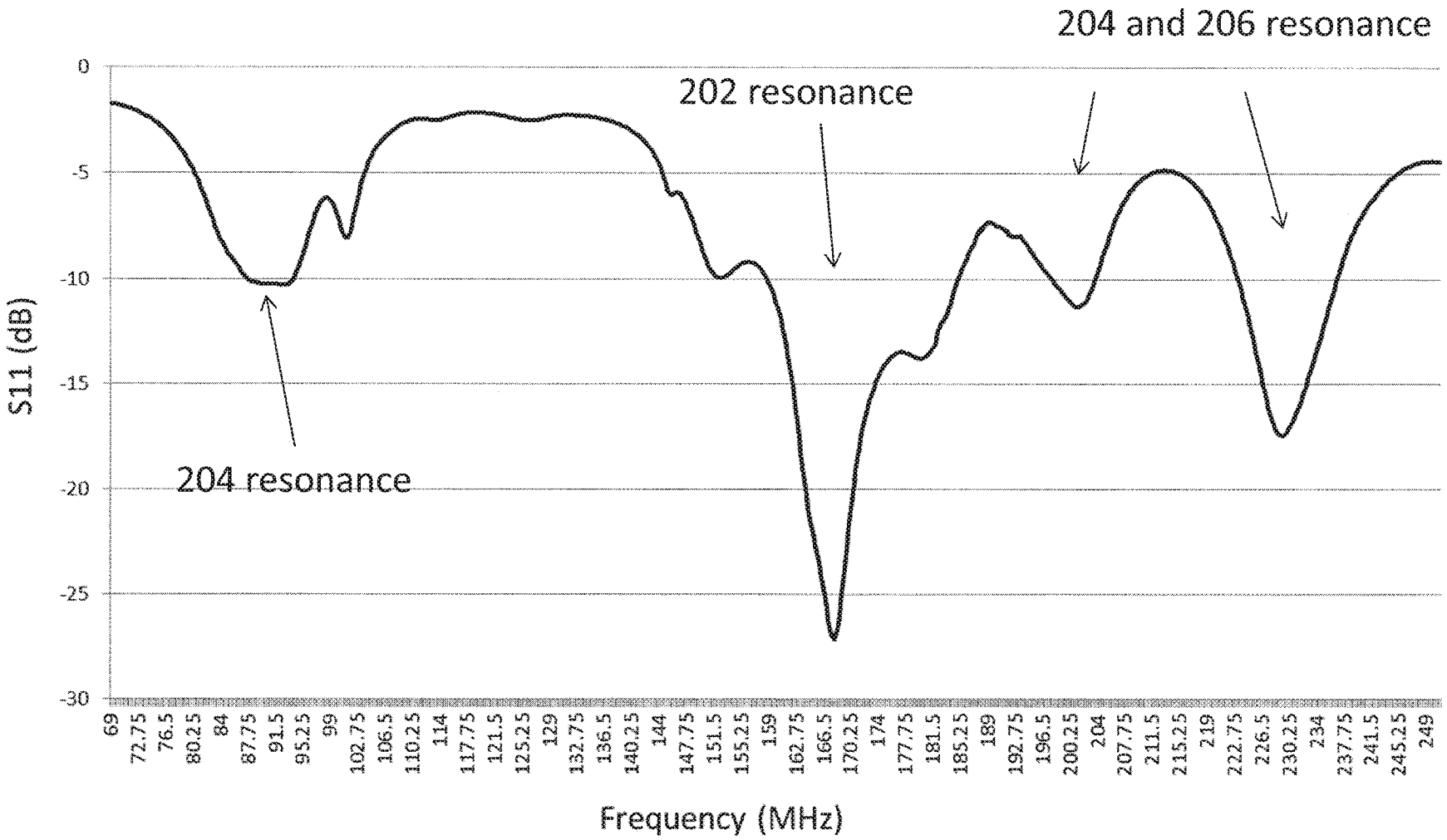
FIG. 5 is a plot of the antenna return loss for antenna resonant frequency bands from 69 to 249 MHz.

An embodiment similar to that illustrated in FIG. 1 was constructed and tested on a vehicle. FIG. 5 is the plot of the return loss (S11) of the wire antenna from the power delivered to the antenna. Return loss S11 is a measure of the power reflected from the antenna and the power "accepted" by the antenna and radiated. FIG. 5 shows that the antenna is matched well in multiple frequency bands from 70 MHz to 250 MHz. The first band is centered at 90 MHz which covers the FM band from 76 MHz to 108 MHz. Since the first band is the lowest frequency band, the resonant frequency is determined by the length of the longest antenna wire 204.

The higher frequency band includes three resonate modes from 150 MHz to 250 MHz. Those frequency bands cover the DAB and TV band 3 from 174 MHZ to 240 MHz. The resonate frequency of the higher band is centered at 167 MHz and is determined by the length of antenna wire 202, which is shorter than antenna wire 204. Resonance at 201 MHz is the second harmonic frequency for antenna wire 204. The third resonance in the high frequency band is centered at 229 MHz and is provided by parasitic antenna wire 206. FIG. 5 shows that in the higher frequency band the resonate frequency is provided by the combination of short antenna wire 202, the high mode (i.e. second harmonic) of long wire 204, and the coupling between the parasitic wire 206 and long wire 204. Consequently, the first frequency band is only slightly affected by changes in the length of antenna wire 202 and 206.

Figure 6:
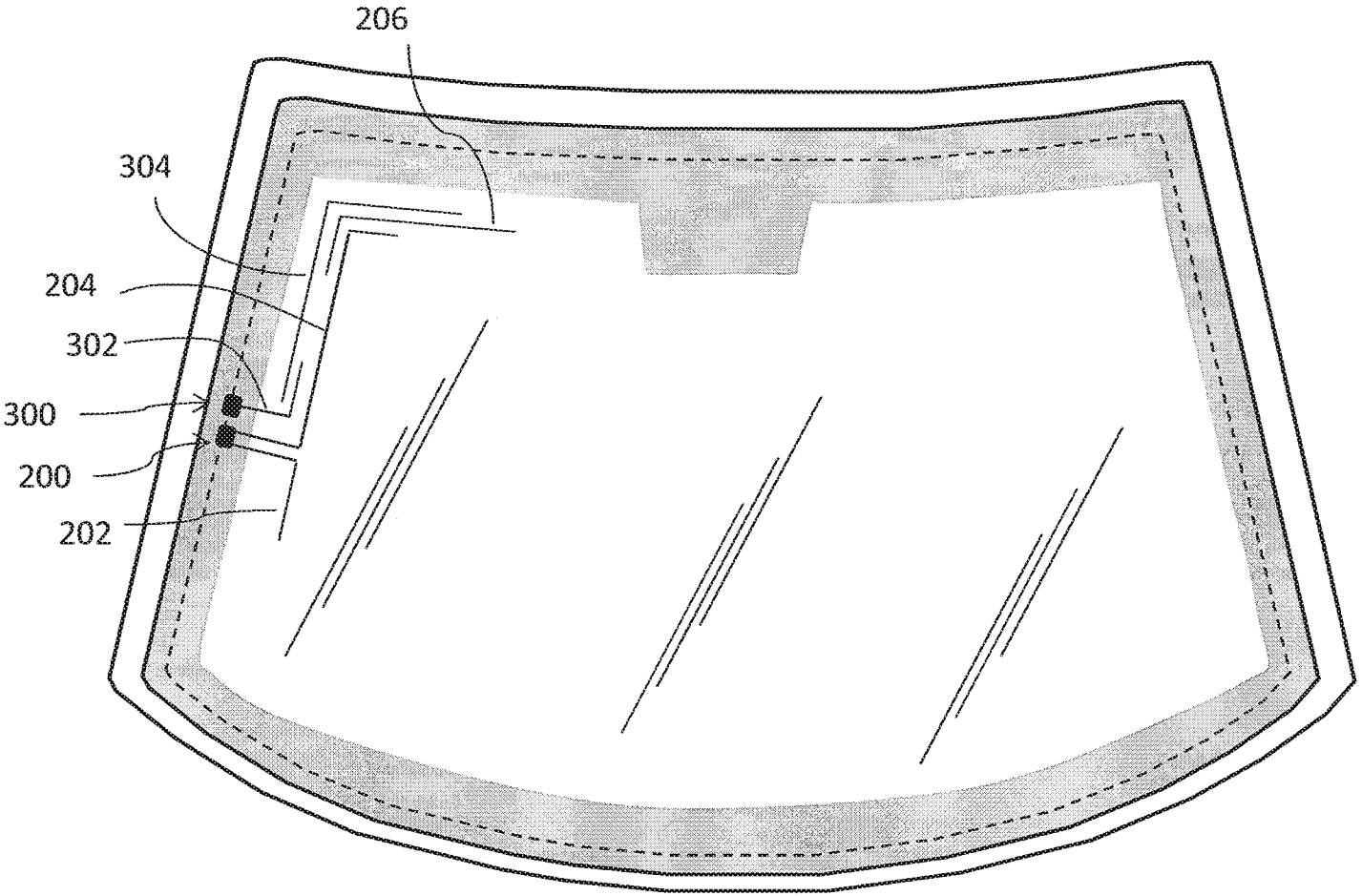
FIG. 6 is a plan view of a windshield wire antenna system with two antennas for FM, DAB and TV applications.

FIG. 6 illustrates another embodiment of the presently disclosed invention wherein a second antenna 300 is added next to antenna 200. Antenna 300 includes antenna wire 302 in combination with antenna wire 304. Antenna 300 is monopole antenna 302 coupled with an L-shape wire 304. Due to close proximity of antennas 200 and 300, they may be coupled through near field electromagnetic coupling. For example, such coupling may enable antenna 200 to be a tunable parasitic antenna resonating element that tunes antenna 300. In like fashion, still more antenna wires may be added to further increase antenna bandwidth. In addition to improving the bandwidth, multiple monopole arms may also improve antenna performance by adding additional impedance resonance to the antenna which is desirable for wide-band antenna applications such as TV antennas. The higher order resonant modes can be used for TV UHF band such as TV band 4 and 5.

Figure 7:
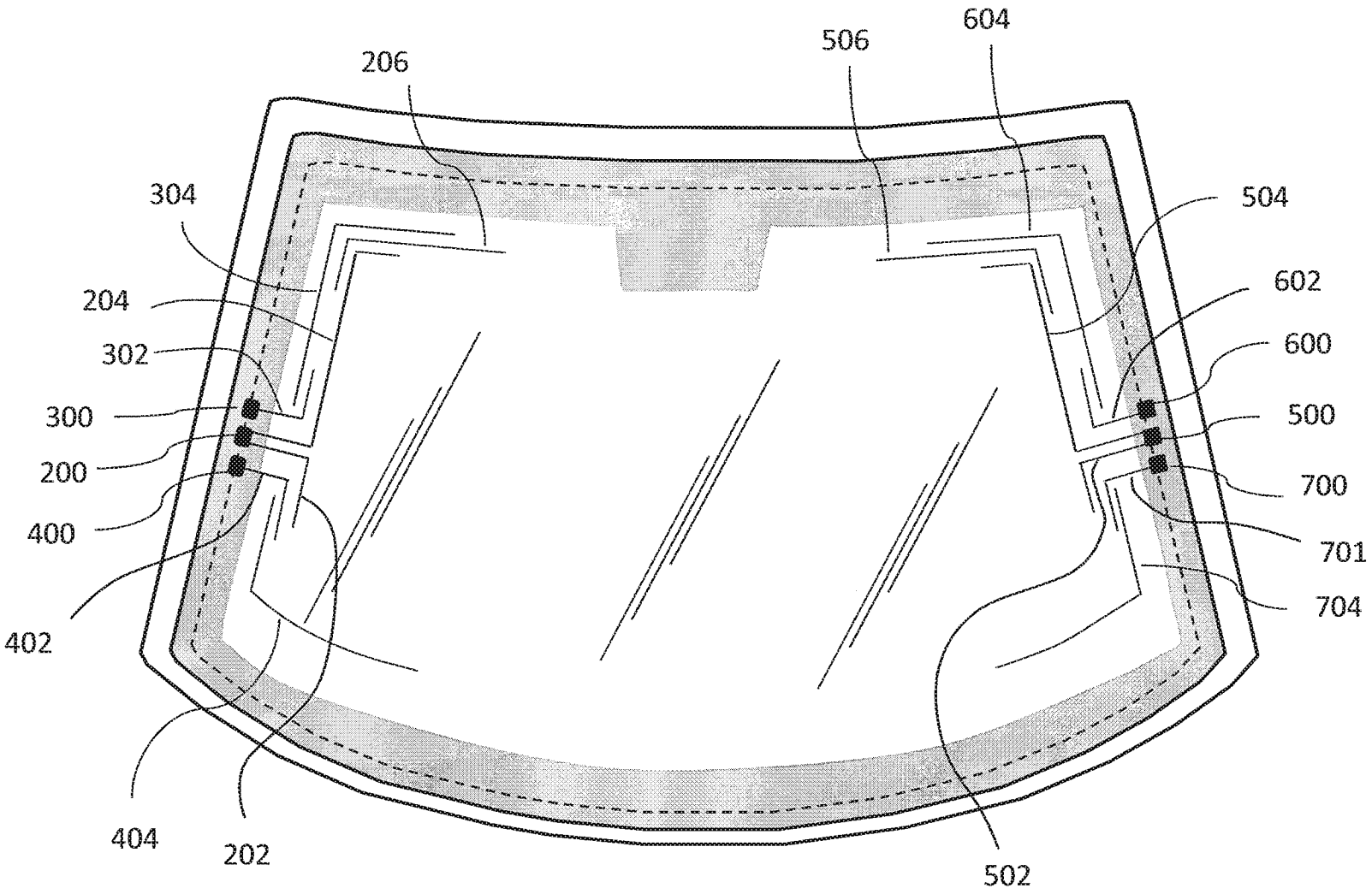
FIG. 7 is a plan view of a windshield wire antenna system with six separate antennas for FM, DAB, and TV diversity reception and RKE application.

The embodiment of FIG. 7 represents a still further development in accordance with the presently disclosed invention. A plurality of antennas as herein disclosed can be located, arranged and fed at respective locations around a window opening to form a diverse antenna system that has respective antennas for different applications. As previously described herein, each of the antennas can be tuned to different respective frequency bands. FIG. 7 illustrates six separate wire antennas 200, 300, 400, 500, 600 and 700. Each antenna is loaded with six respective parasitic coupling wires 206, 304, 404, 506, 604 and 704. Each antenna is fed independently by a connector connected to the solder pad. Each pair of antennas (200, 500); (300, 600); and (400, 700) is symmetrically located along two sides of the windshield. The two antenna feeds in each antenna pair are at least $\lambda/4$ wavelength apart at FM, DAB and TV frequencies and are weakly coupled so that both antennas in the pair can be used simultaneously for an FM, DAB and TV diversity antenna system. Each antenna 200, 300, 400, 500, 600 and 700 also can be tuned to resonate at different frequencies for a variety of automotive wireless applications.

While the disclosed invention has been described and illustrated by reference to certain preferred embodiments and implementations, it should be understood that various modifications may be adopted without departing from the spirit of the invention or the scope of the following claims.

What is claimed is:

1. A window antenna for use with an electrically conductive frame that defines a portal surface, said window antenna comprising:

at least one ply having oppositely disposed surfaces, said at least one ply also having an outer edge that is located between said oppositely disposed surfaces of said ply and that defines the lateral shape of said oppositely disposed surfaces;

an interlayer having oppositely disposed surfaces, said interlayer also having an outer edge that is located between said oppositely disposed surfaces of said interlayer with one surface of said oppositely disposed surfaces of said interlayer facing one of said oppositely disposed surfaces of said at least one ply;

a first antenna wire that is located on at least one of said at least one ply and said interlayer, said first antenna wire having a first longitudinal segment that defines a first end of the first antenna wire, said first longitudinal segment of said first antenna wire being longitudinally oriented perpendicular to said frame, said first antenna wire also having a second longitudinal segment that is joined to said first longitudinal segment and that defines a terminal end of said first antenna wire, the second longitudinal segment of said first antenna wire being oriented with respect to the first longitudinal segment of said first antenna wire such that at least a portion of the second longitudinal segment of said first antenna wire is oriented in non-parallel relationship to the first longitudinal segment of said first respective antenna wire;

a second antenna wire that is located on at least one of said at least one ply and said interlayer, said second antenna wire having a first longitudinal segment that defines a first end of the second antenna wire, said first longitudinal segment of said second antenna wire being longitudinally oriented perpendicular to said frame, said second antenna wire also having a second longitudinal segment that is joined to said first longitudinal segment of said second antenna wire and that defines a terminal end of said second antenna wire, said second longitudinal segment of said second antenna wire being oriented to the first longitudinal segment of said second antenna wire such that at least a portion of said second longitudinal segment of said second antenna wire is oriented in non-parallel relationship to the first longitudinal segment of said second antenna wire, the length of said second antenna wire corresponding to a preselected wavelength;

a third antenna wire having a first terminal end and a second terminal end that located at the opposite end of said third antenna wire from the first terminal end, at least a portion of said third antenna wire being oriented parallel to at least a portion of the second longitudinal segment of said second antenna wire, said portion of said third antenna wire that is parallel to the second longitudinal segment of said second antenna wire being spaced laterally apart from said second longitudinal segment of said second antenna such that said third antenna wire is electrically parasitic to electrical signals in the second longitudinal segment of said second antenna wire, the length of said third antenna wire between said first terminal end and said second terminal end corresponding to the wavelength of a preselected signal frequency; and at least one electrically conductive connector that has one end that is electrically connected to at least one of the first end of said first antenna wire and the first end of said second antenna wire, said at least one electrically conductive connector and having an opposite end that extends across of the outer edge of said at least one ply and the outer edge of said interlayer.

2. The window antenna glazing of claim 1 wherein a conductor for a feed signal is electrically connected the opposite end of said at least one electrically conductive connector.

3. The window antenna of claim 1 wherein said third electrical wire is an L-shape parasitic conductor in that is laterally spaced apart from the terminal end of said second antenna wire.

4. The window antenna of claim 3 wherein said third antenna wire is electromagnetically coupled to said second antenna wire.

5. The window antenna of claim 1 wherein said third antenna wire is a wire that is coated with dark colored coating, said third antenna wire having a center core with a diameter in the range 30 μm to 150 μm.

6. The window antenna of claim 5 wherein said third antenna wire has a center core with a diameter in the range of 60 μm to 90 μm.

7. The window antenna of claim 6 wherein said first antenna wire and second antenna wire are monopole antennas, and wherein said connector, said first antenna wire, said second antenna wire, and said third antenna wire cooperate to define said window antenna.

8. The window antenna of claim 7 wherein said second antenna wire is longer than said first antenna wire, and wherein electrical signals in said first antenna wire resonate at lower frequencies than higher order mode electrical signals in said second antenna wire, and also wherein the fundamental resonate frequency of said second antenna wire defines the first resonate mode of said window antenna.

9. The window antenna of claim 7 wherein the length of said first antenna wire is shorter than the length of said second antenna wire and wherein electrical signals in said first antenna wire resonate at a second resonate mode of said window antenna, and wherein electrical signals in said second antenna resonate at a second resonate mode of said second antenna wire that comprises a third resonant mode, and wherein said third antenna wire is electrically coupled to said second antenna wire and wherein the length of said third antenna wire corresponds to the wavelength of a resonant mode of said third antenna wire that comprises a fourth resonate mode of said window antenna.

10. The window antenna of claim 9 wherein the length of said first, second, and third antenna wires, the spacing between the parallel portions of the second segment of the second wire and third wire, and length of the third wire that parallels the second segment of the second antenna wire establish said second resonate mode, said third resonate mode and said fourth resonate mode that cooperate to form a wide antenna bandwidth.

11. The window antenna of claim 7 wherein said first window antenna has a plurality of fundamental and higher order resonate modes that cooperate to form a continuous frequency bandwidth for the antenna or a plurality of discrete frequency bands for the antenna.

12. The window antenna of claim 11 further comprising additional antenna wires that are coupled to one or more of said first antenna wire and said second antenna wire to provide wider bandwidth and additional higher-order modes.

13. The window antenna of claim 11 further comprising a second window antenna that includes a fourth antenna wire that is located on at least one of said at least one ply and said interlayer, said fourth antenna wire having a first longitudinal segment that defines a first end and a second longitudinal segment is joined to said first longitudinal segment and that defines a terminal end of said fourth antenna wire, the second longitudinal segment of said fourth antenna wire being oriented with respect to the first longitudinal segment of said fourth antenna wire such that at least a portion of the second longitudinal segment of said fourth antenna wire is oriented in non-parallel relationship to the first longitudinal segment of said fourth antenna wire;

a fifth antenna wire having a first terminal end and a second terminal end that is located at the opposite end of said fifth antenna wire from the first terminal end, at least a portion of said fifth antenna wire being oriented parallel to at least a portion of the second longitudinal segment of said fourth antenna wire, said portion of said fifth antenna wire that is parallel to the second longitudinal segment of said fourth antenna wire being spaced laterally apart from said second longitudinal segment of said fourth antenna wire such that said fifth antenna wire is electrically parasitic to electrical signals in the second longitudinal segment of said fourth antenna wire, the length of said fifth antenna wire between said first terminal end and said second terminal end of said fifth antenna wire corresponding to the wavelength of a preselected order of a harmonic of the fourth antenna wire; and a second electrically conductive connector that has one end that is electrically connected to the first end of said fourth antenna wire, said second electrically conductive connector and having an opposite end that extends across of the outer edge of said at least one ply and the outer edge of said interlayer.

14. The window antenna of claim 13 wherein said second window antenna resonates within frequency band that is outside the frequency band at which said first window antenna resonates.

15. The window antenna of claim 14 wherein at least one of the fourth and fifth antenna wires of said second window antenna is electrically coupled to at least one of the first, second and third antenna wires of said first window antenna such that one of said first and second window antennas is a tunable parasitic antenna that comprises resonate elements for the other of said first and second window antennas.

16. The window antenna of claim 15 wherein said first window antenna transmits and receives radio frequency signals in the range of 76 MHz to 108 MHz and in the range of 170 MHz to 240 MHz.

17. The window antenna of claim 15 wherein said second window antenna transmits and receives radio frequency signals in the range of 170 MHz to 240 MHz and in the range of 470 MHz to 800 MHz.

18. The window antenna of claim 15 wherein said window antennas receive and transmit signals in a frequency band that includes FM, TV VHF, TV UHF, Remote keyless entry, and DAB band III frequency bands.

19. The window antenna of claim 13 further comprising a plurality of antennas, each antenna of said plurality of antennas being located at a respective positions within the window opening.

20. The window antenna of claim 19 and wherein said plurality of antennas is located at two sides of said glazing, each antenna of said plurality of antennas having an antenna wire with a feed for that antenna wire is at least $\lambda/4$ wavelength apart at FM, DAB and TV frequencies such that the antennas are weakly coupled and can be used simultaneously for FM, DAB and TV in a diverse antenna system.

21. The window antenna of claim 19 wherein each antenna of said plurality of antennas is respectively tuned to a different frequency band.

* * * * *